United States Patent [19]

Nolet

[11] 4,173,216

[45] Nov. 6, 1979

[54] MASSAGE DEVICE

[76] Inventor: Roland Nolet, 14 Belle Pl., Ste-Rose, Laval, Quebec, Canada, H7L 3G9

[21] Appl. No.: 761,345

[22] Filed: Jan. 21, 1977

[51] Int. Cl.[2] ..... A61H 29/00

[52] U.S. Cl. ..... 128/24.1; 128/25 B; 128/26; 128/400

[58] Field of Search ..... 128/25 B, 26, 67, 32, 128/33, 24.1, 24.2, 57, 64, 400; 237/77; 165/46

[56] References Cited

U.S. PATENT DOCUMENTS

| | | | |
|---|---|---|---|
| 2,466,470 | 4/1949 | Norris | 128/57 |
| 2,820,454 | 1/1958 | Wright | 128/25 B |
| 2,880,721 | 4/1959 | Corcoran | 128/25 B |
| 2,943,620 | 7/1960 | Sibert | 128/24.1 |
| 3,028,857 | 4/1962 | Parker | 128/25 B |
| 3,720,204 | 3/1973 | Wojtowicz | 128/64 |

*Primary Examiner*—Lawrence W. Trapp
*Attorney, Agent, or Firm*—Daniel Jay Tick

[57] ABSTRACT

Material having bumps formed therein and extending from the surface thereof covers an item and comes into close contact with the bottoms of the feet or the palms of the hands of a user.

1 Claim, 11 Drawing Figures

5

TO DRAIN
TO WATER SUPPLY
7
1
2
6
8
10
9

14
4
13
11
12

15

3

16
17
21
20
22

24
23
XI 18
19

MASSAGE DEVICE

BACKGROUND OF THE INVENTION

The present invention relates to a massage device. More particularly, the invention relates to a massage device for massaging the bottoms of the feet and the palms of the hands of a user.

Objects of the invention are to provide a massage device of simple structure, which is inexpensive in manufacture, used with facility and convenience, and functions efficiently, effectively and reliably to massage the bottoms of the feet and the palms of the hands of a user thereby aiding blood circulation and enhancing the good feeling and general wellbeing of the user.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figures 1, 2, 3, 4, 5, 6, 7, 8, 9, 10, 11:
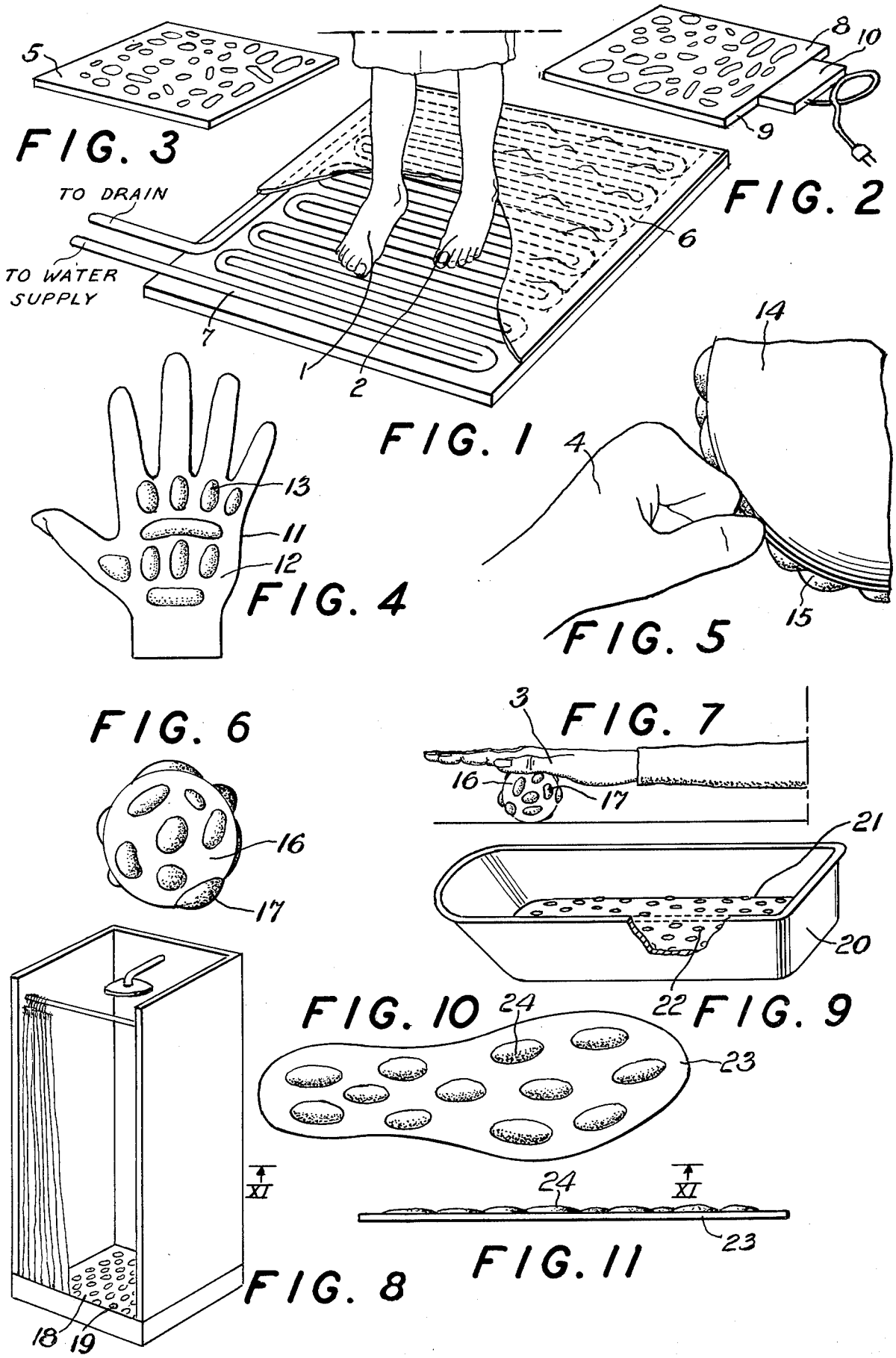
FIG. 1 is a partly cutaway view of a first embodiment of the massage device of the invention.
FIG. 2 is a view of a second embodiment of the massage device of the invention.
FIG. 3 is a view of a third embodiment of the massage device of the invention.
FIG. 4 is a view of a fourth embodiment of the massage device of the invention.
FIG. 5 is a view of a fifth embodiment of the massage device of the invention.
FIG. 6 is a view of sixth embodiment of the massage device of the invention.
FIG. 7 is a view illustrating the use of the embodiment of FIG. 6.
FIG. 8 is a view of a seventh embodiment of the massage device of the invention.
FIG. 9 is a view of an eighth embodiment of the massage device of the invention.
FIG. 10 is a top plan view of a ninth embodiment of the massage device of the invention.
FIG. 11 is a view, taken along the lines XI—XI, of FIG. 10.

The massage device of the invention functions to massage the bottom of the feet and the palms of the hands of a user.

The massage device of the invention comprises material having bumps, nodes, lumps, or the like, formed therein and extending from the surface thereof. The material, in order to retain the bumps, nodes, or the like, is semirigid. The material of the invention covers an item and comes into close contact with the bottom of the feet 1 and 2 (FIG. 1) or the palms of the hands 3 (FIG. 7) and 4 (FIG. 5) of a user.

In the embodiment of FIG. 3, the item comprises a floor and the material comprises a carpet 5 covering the floor.

In the embodiment of FIG. 1, the item comprises a floor and the material comprises a carpet 6 covering the floor. However, a pipe 7 is provided on the floor under the carpet and has water circulating therethrough.

In the embodiment of FIG. 2, the item comprises a floor and the material comprises a carpet 8 covering the floor. A plate 9 is provided between the floor and the carpet, and an electric vibrator 10 is coupled to the plate for vibrating said plate.

In the embodiment of FIG. 4, the item comprises a glove 11 and the material comprises a lining 12 having a plurality of bumps, lumps, nodes, or the like 13, formed therein and extending from the surface thereof toward the palm of a hand in the glove.

In the embodiment of FIG. 5, the item comprises a punching bag and the material comprises a cover 14 for the punching bag having a plurality of bumps, nodes, lumps, or the like 15, formed therein and extending from the surface thereof.

In the embodiment of FIGS. 6 and 7, the item is a hand ball and the material is a cover 16 for such ball, having bumps, nodes, or the like 17, and so on, formed therein and extending from the surface thereof, as shown.

In the embodiment of FIG. 8, the item is a shower floor and the material comprises a cover 18 for the shower floor, having bumps or the like 19 formed therein and extending from the surface thereof.

In the embodiment of FIG. 9, the item is the bottom of a bathtub 20 and the material is a cover therefor 21, having a plurality of bumps, protrusions, nodes, or the like 22, and so on, formed therein and extending from the surface thereof.

In the embodiment of FIGS. 10 and 11, the item is a shoe and the material is an inner sole 23 having bumps, nodes, or the like 24, and so on, formed therein and extending from the surface thereof, as shown.

While the invention has been described by means of specific examples and in specific embodiments, I do not wish to be limited thereto, for obvious modifications will occur to those skilled in the art without departing from the spirit and scope of the invention.

I claim:

1. A massage device for massaging the bottoms of the feet and the palms of the hands of a user on a supporting surface, said massage device comprising carpet having an upper surface and bumps formed therein and extending from the upper surface thereof, said carpet covering the supporting surface and coming into close contact with the bottoms of the feet or the palm of the hands of a user; and a pipe on the supporting surface under the carpet and having water circulating therethrough.

* * * * *